United States Patent [19]

Hopper

[11] 4,039,019

[45] Aug. 2, 1977

[54] APPARATUS FOR INSULATING AGAINST CONDUCTIVE, CONVECTIVE, AND RADIANT HEAT TRANSMISSION

[76] Inventor: Thomas P. Hopper, R.F.D. No. 1, Box 689, Durham, Conn. 06422

[21] Appl. No.: 652,628

[22] Filed: Jan. 26, 1976

[51] Int. Cl.[2] ..... E06B 9/08

[52] U.S. Cl. ..... 160/121 R

[58] Field of Search ..... 160/25, 41, 120, 121, 160/122, 237, 238

[56] References Cited

U.S. PATENT DOCUMENTS

| | | | |
|---|---|---|---|
| 2,247,634 | 7/1941 | Houston | 160/121 |
| 2,324,423 | 7/1943 | Pidgeon | 160/41 |
| 2,852,143 | 9/1958 | Taber | 160/238 |
| 3,231,006 | 1/1966 | Fisher et al. | 160/41 |

*Primary Examiner*—Peter M. Caun

*Attorney, Agent, or Firm*—St.Onge, Mayers, Steward & Reens

[57] ABSTRACT

An apparatus for insulating against conductive, convective, and radiant heat transmission comprises three or more mutually parallel non-transparent sheets. The sheets may be attached to a retracting device from which they can be drawn to extend in mutually parallel relation and cover a building opening such as a window or onto which they can be retracted to uncover the opening. A number of resilient spacers in the form of collapsible devices are mounted within the apparatus to separate each pair of adjacent sheets and, thus, define a dead air space therebetween.At least one of the sheets has a highly radiation reflective surface located to face on a dead air space. Importantly, the collapsible devices are designed so as not to abrade or otherwise harm the reflective surface. The combination of these dead air spaces with the highly radiation reflective sheet surfaces results in an apparatus having extremely low emissivity that effectively impedes radiant heat transfer. The dead air spaces also effectively impede conductive and convective heat transfer.

8 Claims, 10 Drawing Figures

Fig. 4.
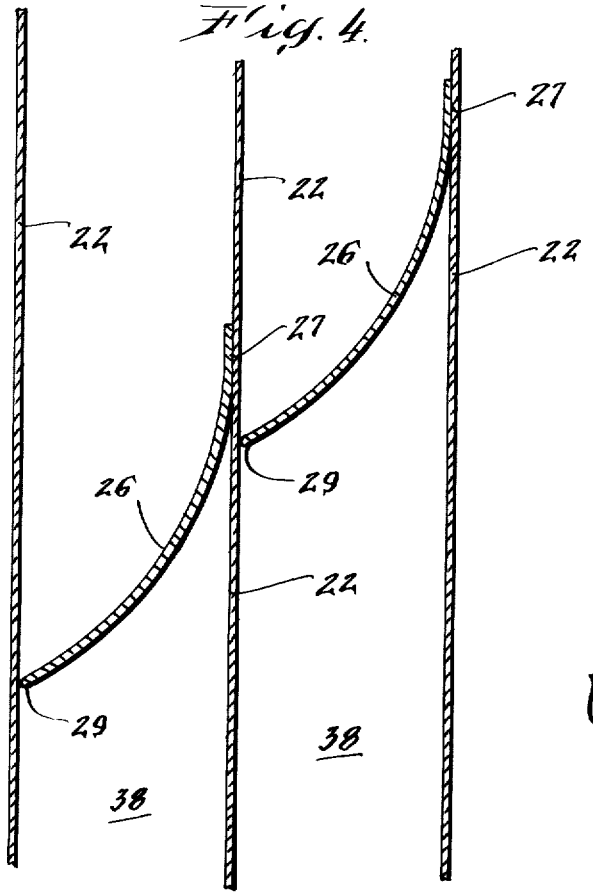
Fig. 5.
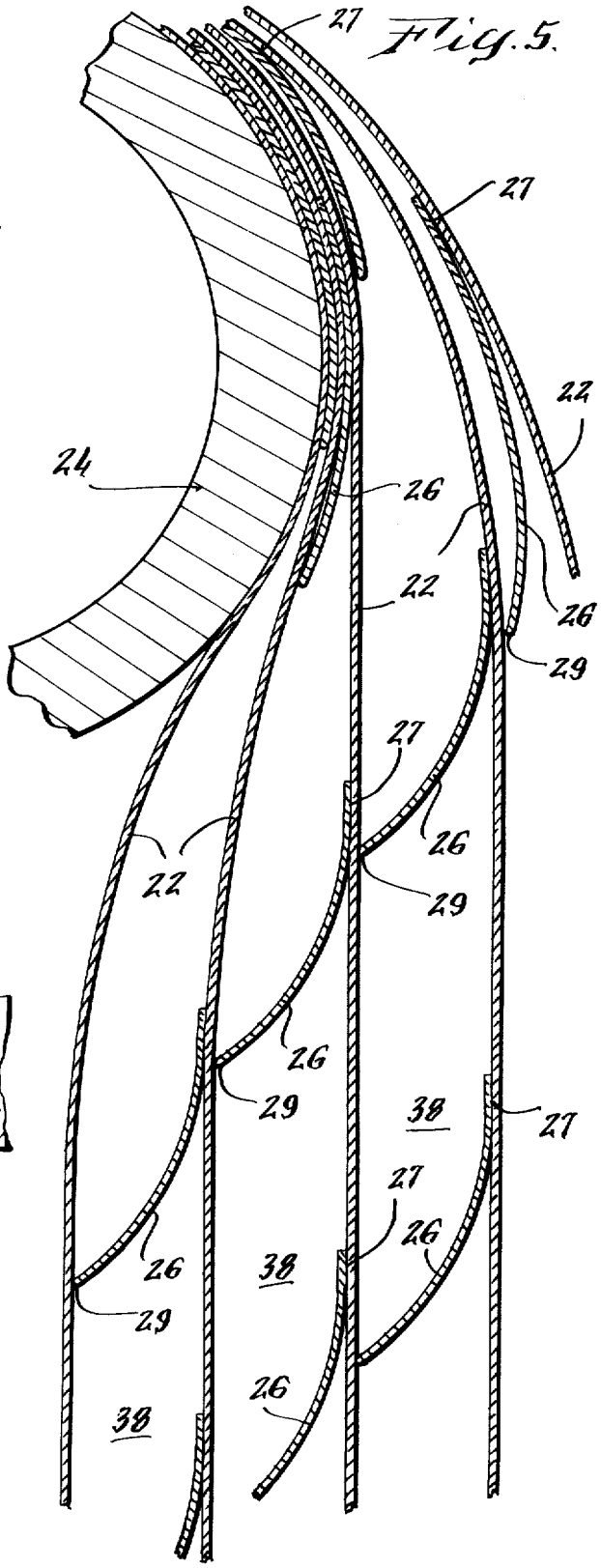
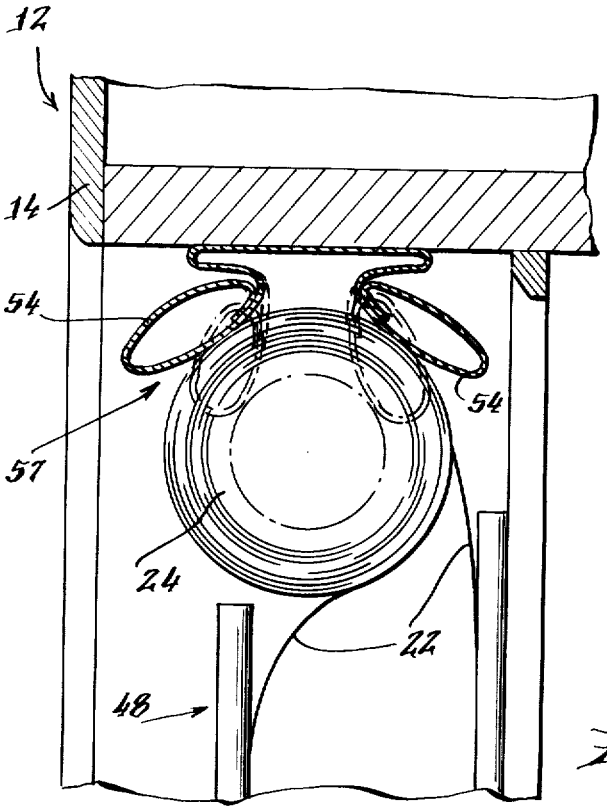
Fig. 6.

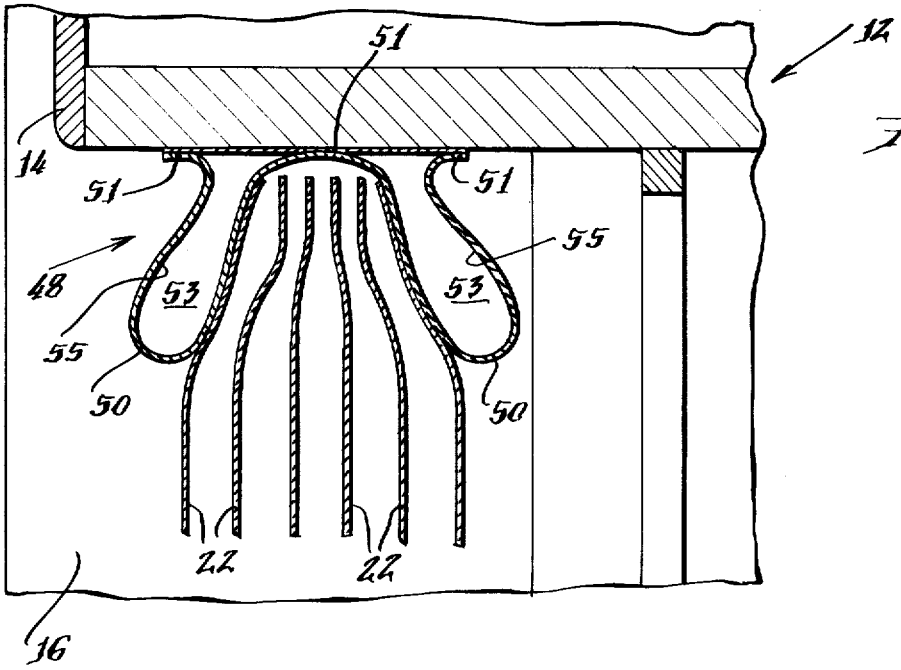
Fig. 7.
Fig. 8.
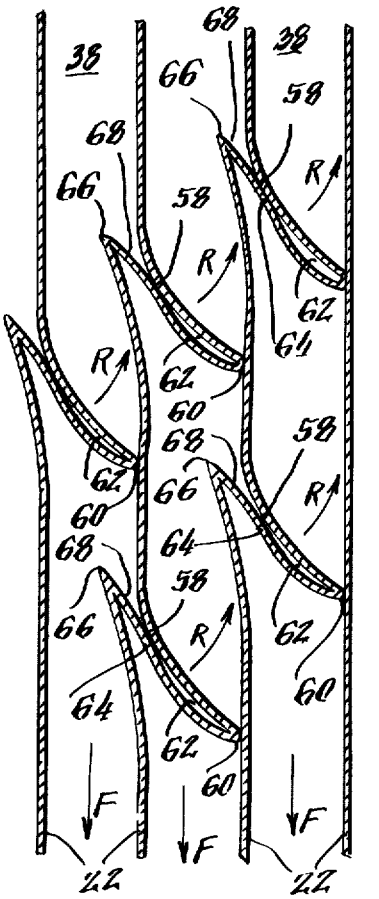
Fig. 9.
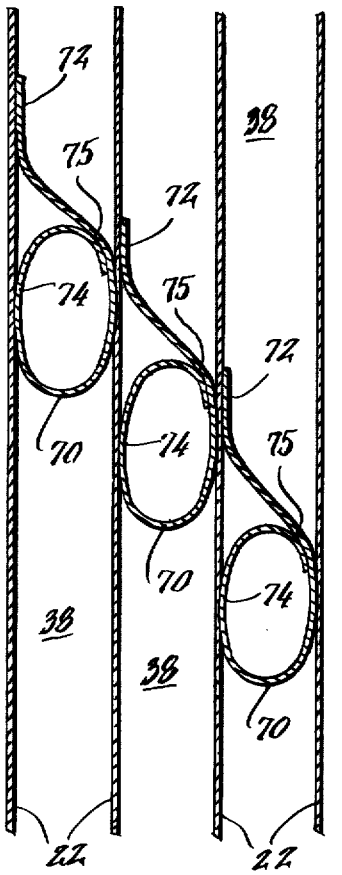
Fig. 10.
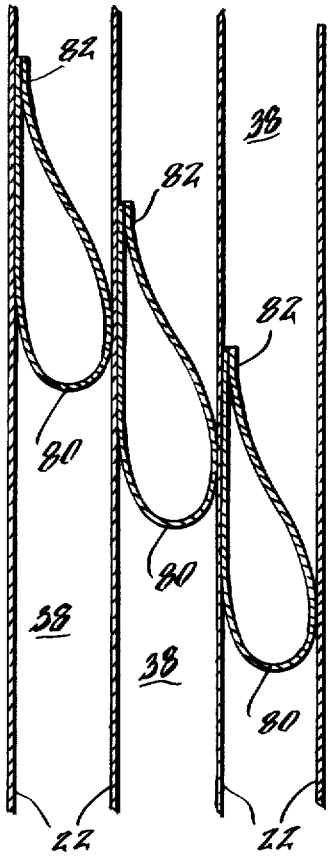

APPARATUS FOR INSULATING AGAINST CONDUCTIVE, CONVECTIVE, AND RADIANT HEAT TRANSMISSION

BACKGROUND OF THE INVENTION

1. Field of the Invention

The present invention relates to an apparatus for providing insulation against radiant, conductive, and convective heat transmission in areas in which only relatively thin insulators may be installed. This apparatus may take the form of a shade and may be used to insulate areas such as windows and doors in residential, commercial, and industrial buildings that ordinarily are relatively good heat transmitters.

It has become increasingly apparent in recent years that presently known sources of energy derived from the earth are finite and are, in fact, being rapidly depleted. Therefore, energy conservation has become a subject of great national concern.

The heating and cooling systems of residential, industrial, and commercial buildings use approximately 25% of all energy consumed in the United States. It is important to note, therefore, that transparent single pane or double insulated pane windows in these buildings are very poor heat insulators and consequently represent a significant cause of inefficient energy consumption. For example, in winter the heat loss per unit area through windows is typically three to ten times as great as that through adjacent walls depending on the type of wall insulation. Similarly, in summer the total heat entering through a sunlit window may be more than ten times that through the adjacent wall. (See, ASHRAE, Handbook of Fundamentals (1972); R. C. Dix and Z. Lavan; "Window Shades and Energy Conservation"; Mechanics, Mechanical and Aerospace Engineering Department, Illinois Institute of Technology, 1974). Therefore, substantial amounts of energy can be saved if window areas are effectively insulated. However, it is desirable to do so without permanently blocking windows and thus preventing their use for ventilation as well as for visual access to the outside world.

It may also be advantageous to insulate other areas where the permissible thickness of insulation is limited.

DESCRIPTION OF THE PRIOR ART

Various attempts have been made to provide insulation against heat transmission through building areas such as windows where only thin apparatus can be installed. For example, research conducted at the Illinois Institute of Technology by R. C. Dix and Z. Lavan and published under the title "Window Shades and Energy Conservation" shows that a simple, single-sheet window shade is superior to either draperies or venetian blinds in preventing unwanted heat loss through windows. Further, the insulating effect is improved if the shade is sealed at its edges with tape and provided with a white or silver reflective surface (Id. at 23).

U.S. Pat. No. 2,306,086 (Smith) discloses a thermally insulating window shade construction that is retractibly mounted at the top of a window frame and includes two shade sheets separated by a spacer in the form of a wooden rod fixed with the window frame. However, this device has certain practical disadvantages. The spacer rod has a tendency to abrade the sheets when drawn past it causing them to wear. Further, no provision is made for sealing the shades to the window frame or for otherwise preventing convection air currents from developing in the space between the shade sheets when drawn over the window. This is a major source of breakdown of insulating effectiveness provided by the Smith construction.

ASHRAE, Handbook of Fundamentals (1972) considers the total emissivity of two surfaces having various reflectivities which enclose a single air space.

Other shade constructions are disclosed in U.S. Pat. Nos. 2,140,049 (Grauel); 2,328,257 (Butts); and 2,865,446 (Cole). Each of these constructions is designed to control the admission of light and air through a window in the manner of a conventional shade and is not well suited for use as an insulator against heat loss. For example, the shade apparatus disclosed in the Grauel and Butts Patents include perforated sheets which induce convection air currents about the shade sheets and windows on which the sheets are installed. Similarly, the shade sheets used by the Cole device are made of an open mesh fabric which would not prevent development of such convection air currents.

Retractible window apparatus are disclosed in U.S. Pat. Nos. 2,247,634 (Houston); and 2,361,762 (Glenn et al.). However, both apparatus are as poor heat insulators as are conventional windows.

SUMMARY OF THE INVENTION

As described below in detail, the apparatus of the present invention is mounted to temporarily or permanently cover an area to be insulated against heat transmission. The area may be a wall or an opening, such as a window, in a building. When embodied in its preferred form, used to insulate a window, the apparatus functions as a shade which may be either completely drawn or opened or set in any position in between and, consequently, need not inhibit normal operation of the window to admit air for ventilation or to admit light. However, when the shade apparatus is drawn at night during the winter months, significant energy savings are realized by preventing substantial loss of heat, generated by the heating system of the building, through the window. Similarly, when this shade apparatus is drawn during the day in the summer months, significant energy savings are realized by limiting admission of heat and thus reducing the need for cooling ordinarily provided by the air conditioning system of the building.

The shade apparatus of this preferred embodiment is designed for use with conventional windows, for example, those of the double hung type slidably mounted in a frame. The apparatus includes at least three opaque or translucent, that is, essentially non-transparent, imperforate shade sheets, at least one of which has a reflective surface and all of which are attached to a retracting roller that is mounted to horizontally span the window frame at its upper end. The sheets may be drawn downwardly from the roller to cover the window or may be retracted back unto the roller to uncover the window. Of course, the shade apparatus may be mounted to be drawn sidewardly across the window.

A number of resilient spacers, in the form of collapsible devices, are mounted with one sheet of each pair of adjacent shade sheets to separate those sheets when they are drawn to cover the window. These spacers are collapsible so that when retracted onto the roller, the layers of sheets may be tightly compacted thereon. Further, since the spacers are mounted with individual shade sheets and travel with them during drawing and retracting operations, minimal abrasion which would tend to wear the sheet or scratch the reflective surface occurs.

The outer sheet layer of the composite shade apparatus is continuous at the bottom to prevent convection currents from developing in the dead air spaces defined between adjacent sheets with the apparatus is drawn. Further, resilient sealing constructions are provided which prevent convection air currents from developing between the shade apparatus and the window opening.

Thus, the multiple dead air spaces defined between adjacent shade sheets form an effective thermal insulator against conductive and convective heat losses. Moreover, the reflective sheet surfaces in cooperation with these multiple dead air spaces provide an apparatus having extremely low emissivity, highly effective to impede radiant heat transfer.

The shade apparatus of the present invention also provides certain practical advantages. In particular, it can be installed as easily as a conventional shade using similar hardware. Since the highly reflective surfaces incorporated in the apparatus are not abraded or scratched by the spacers, a long useful life of the shade apparatus to effectively insulate a window against heat transmission may be realized. Since the apparatus is simple it may be economically manufactured and, therefore, placed in wide use.

The apparatus of the invention may be used to insulate other building areas such as floor-to-ceiling length windows, sliding glass or non-glass doors and conventional doors. Further, the apparatus may be embodied in forms other than a shade. For example, it may be mounted in extended, non-retractible fashion to insulate a wall or other area.

Accordingly, it is an object of the present invention to provide a apparatus which effectively and practically insulates against convective, conductive, and radiant heat transmission through building areas which permit insulation of devices having relatively narrow thickness.

Other objects, aspects, and advantages of the present invention will be pointed out in, or will be understood from the following detailed description provided below in conjunction with the accompanying drawings.

BRIEF DESCRIPTION OF THE DRAWINGS

FIG. 4 is a further enlarged partial cross-sectional view similar to that shown in FIG. 3 illustrating preferred devices for spacing adjacent shade sheets apart to define a dead air space therebetween.

FIG. 5 is a second enlarged cross-sectional view of these spacer devices showing the manner in which they collapse when retracted onto the roller.

FIG. 6 is a vertical cross-sectional view of an arrangement for sealing the top of the shade apparatus, alternative to that shown in FIG. 3, to prevent convection currents from developing between the apparatus and the window.

FIG. 7 is a horizontal cross-sectional view taken through plane 7—7 in FIG. 1 looking downward showing a suitable arrangement for sealing the sides of the shade apparatus to prevent development of such convection currents.

FIGS. 8, 9 and 10 are enlarged partial vertical cross-sectional views similar to that shown in FIG. 3 illustrating alternative devices for spacing adjacent shade sheets apart to define a series of dead air spaces.

DETAILED DESCRIPTION OF THE PREFERRED EMBODIMENTS

Figure 1:
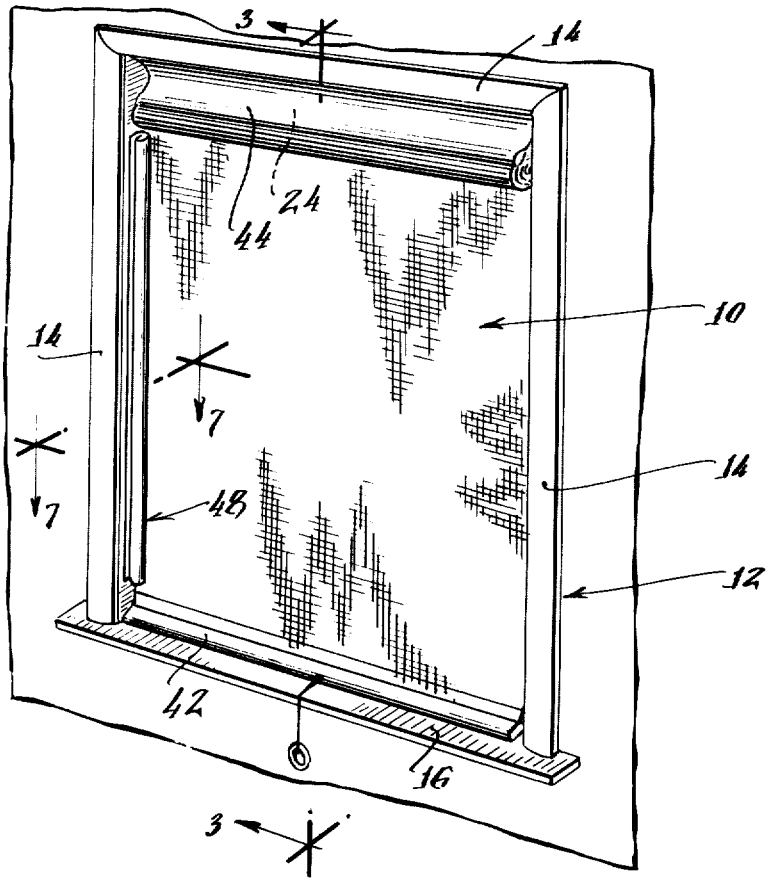
FIG. 1 is a perspective view illustrating the shade apparatus of the present invention in its drawn position from the inside of a conventional window in which it is mounted.
Figure 2:
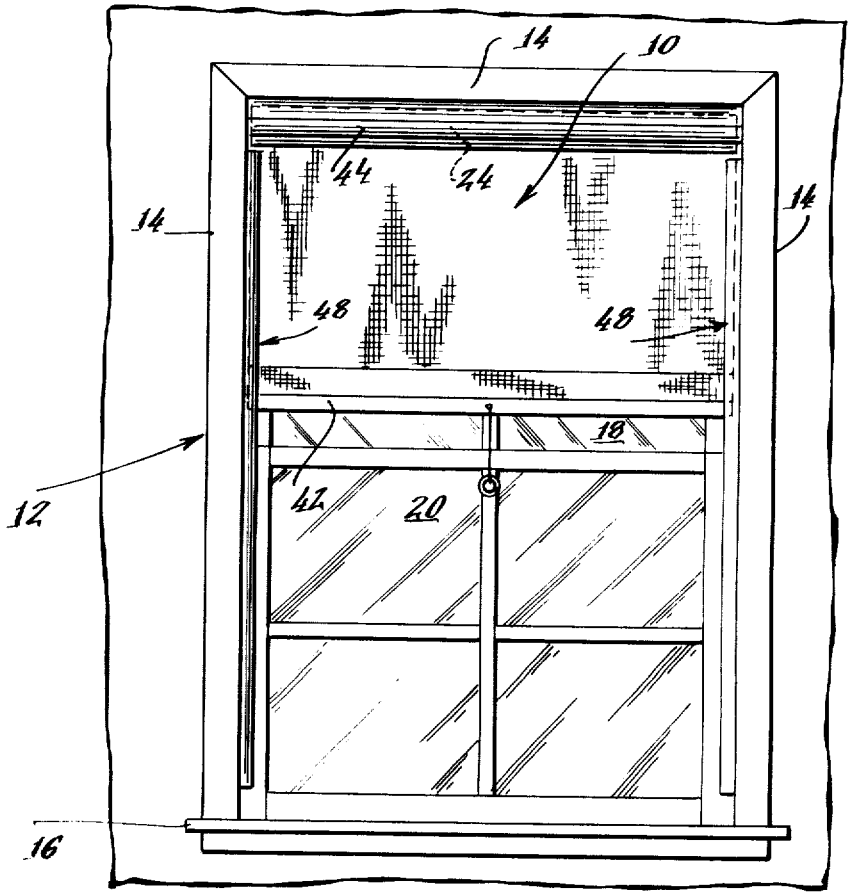
FIG. 2 is a front elevational view of this shade apparatus, also from the inside of the window in which it is mounted, illustrating it in a partially drawn position.

As shown in FIGS. 1 and 2, the apparatus of the present invention, embodied in the form of a shade and generally indicated at 10, is mounted to be drawn over a conventional window, generally indicated at 12, to insulate the window against convective, conductive and radiant heat transmission. However, this shade apparatus may be used with equal advantage to insulate any other opening, such as a sliding glass door, in a commercial, institutional, industrial or residential building against heat transmission. Similarly, it may be embodied as a permanent nonretractible insulator for, as an illustration, a wall. Nevertheless, by way of example, the window 12 may be of the double hung type which comprises a frame 14 that extends about the sides and top and a sill 16 that projects horizontally outwardly from the bottom. A closure in the form of upper and lower multiple glass panes, 18 and 20 respectively, is mounted in a well-known manner with each pane slidably carried in vertically extending tracks (not shown) for upward and downward movement. Further, these glass panes are recessed in the frame 14.

Figure 3:
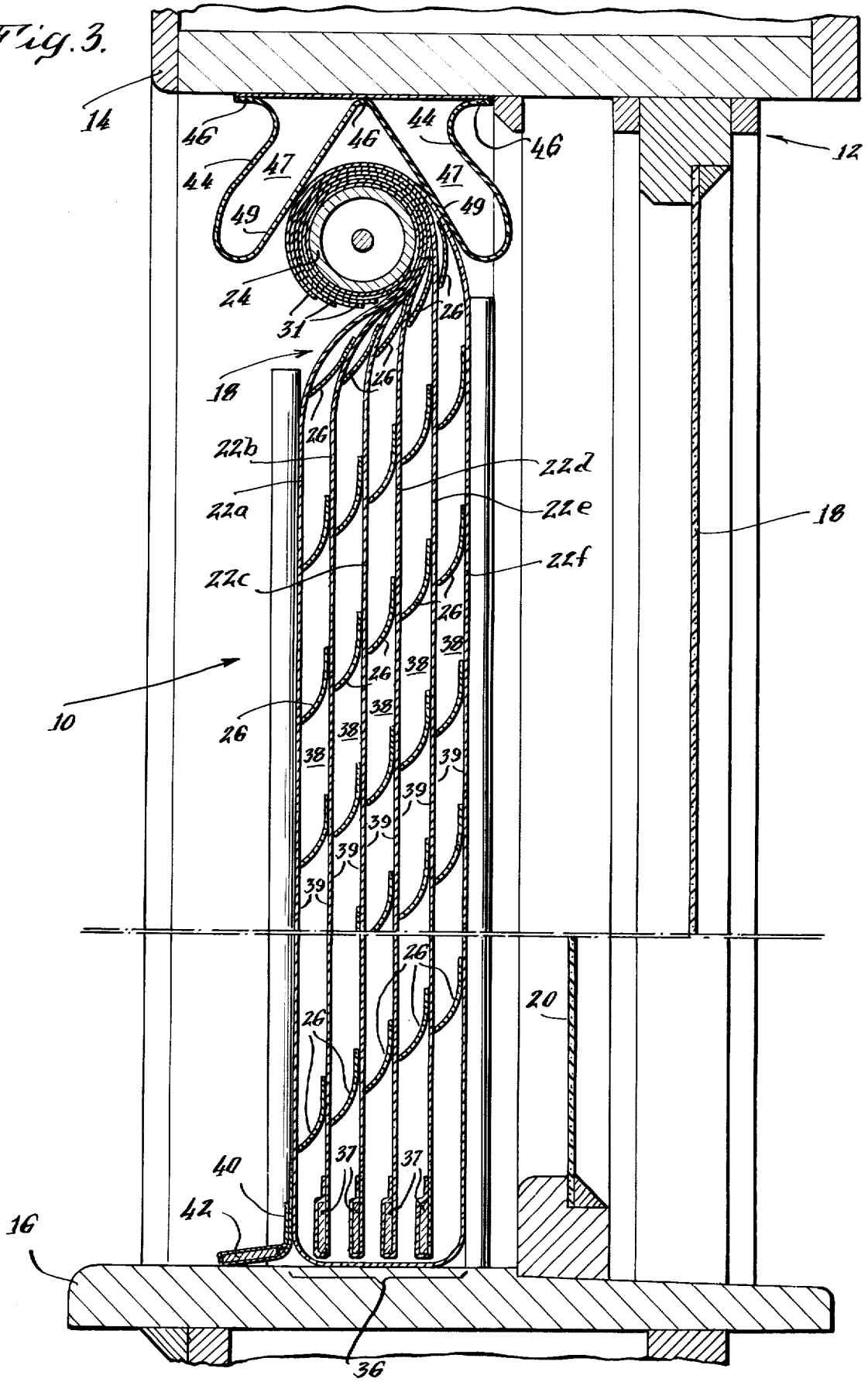
FIG. 3 is a vertical cross-sectional view of this shade apparatus and window taken through plane 3—3 in FIG. 1 looking toward the left.

As shown in FIG. 3, the shade apparatus 10 includes a number of essentially non-transparent, imperforate shade sheets 22 which are attached to a retracting roller 24 that is mounted to horizontally span frame 14 at its upper end. (Note that the thickness of shade sheets 22 is exaggerated in the interest of clarity.) Readily available or slightly modified hardware may be used to mount the roller which may advantageously include a conventional, spring-loaded retracting mechanism (not shown) like that commonly used in ordinary window shades. This retracting mechanism provides a means for moving the shade sheets between a drawn position (FIGS. 1 and 3) and a tightly compacted, retracted position.

One sheet of each pair of adjacent shade sheets 22 is provided with a number of devices 26 for spacing the adjacent sheets apart when in the drawn position as shown in FIG. 3. Moreover, these spacer devices may be mounted more closely together at the top of each sheet to effectively separate adjacent sheets in the region where they tangentially leave roller 24 and thus have a tendency to lie together.

In the preferred embodiment as shown in detail in FIG. 4, each spacer device 26 is formed of an elongated elastic tape-like strip to assume a partially cylindrical or arcuate shape having an axis parallel to the major axis of the tape-like strip, and is attached, for example by heat welding, at its upper edge 27 to the sheet surface to extend horizontally or transversely thereacross. (Note that the thickness of spacer devices 26 is also exaggerated in the interest of clarity.) However, the lower edge 29 of each device is free. Further, each device 26 is made from a material having a high "elastic memory", that is, the material when formed to its desired arcuate shape, naturally reverts to that shape after deformation. Accordingly, devices 26 separate adjacent sheets along the entire extended sheet length in order to define a dead air space 38 therebetween. Therefore, these dead air spaced operate as insulators against conductive and convective heat transmission.

As shown in FIG. 5, the spacer devices 26 tightly compact on roller 24 when the shade sheets 22 are retracted thereon by virtue of their design. Specifically, the radius of curvature of each spacer device matches the radius of the roller 24 as it rolls thereon and the lower strip edge 29 slides only slightly downwardly on the sheet adjacent that to which it is attached. The free end 29 is preferably rounded to insure that the sliding movement, though slight, is also smooth. However, since the spacer device has high elastic memory, when the apparatus is extended from roller 24, each device tends to maintain or remember the radius of the roller 24 to space adjacent sheets apart in a manner opposite to that when the sheets are retracted.

Referring again to FIG. 3, the trailing ends 31 of the respective sheets 22 are attached to the curved roller surface in circumferentially staggered fashion. The spacer devices are also staggered from one sheet to the next in slanted vertical arrays so that only a small portion of one collapses against another on an adjacent sheet when the apparatus is retracted. Accordingly, distribution of the sheet and spacer device material is relatively even when the apparatus is retracted onto the roller. Therefore, though the apparatus may comprise many sheets, they are stored on roller 24 in a relatively compact way to occupy little more space than an ordinary shade. For example, it has been found that an apparatus having three sheets that is eight feet long and has thickness of one and one-half inches when extended, has a retracted diameter of 2 inches on a roller having a diameter of 1 inch.

As shown in FIG. 3, the outermost sheets **22*a* and 22*f* are interconnected at location 36 by virtue of being formed of the same sheet of material. Further, each of the single internal sheets 22*b* through 22*e* is provided with an elongated weight 37 at its leading end to provide full sheet extension to a point contactng or nearly contacting continuous sheets 22*a*–22*f* at location 36. The respective dead air spaces 38 are, thus, sealed at the bottom by the outer sheets 22*a* and 22*f* and their contact with the internal sheets 22*b*–22*e*** to prevent the development of convection air currents therein. This is particularly desirable since such convection currents would interfere with effective operation of the dead air spaces to prevent conductive and convective heat transmission.

As the sheets are retracted onto the roll, the radii to the sheets outermost from the roller axis are greater than that to those nearer the roller axis. Therefore, sheet **22*f* will be retracted onto roller 24 more rapidly than sheet 22*a*. However, the continuous shade sheet construction permits easy retraction without binding in spite of this occurrence since the sheet 22*a*–22*f* pivots at location 36. Moreover, the weighted ends of internal sheets 22*g*–22*e* retract in staggered fashion because of the difference in radius to the respective sheets on the roller. Suitable discs or large washers may be installed at the ends of roller 24** to insure that the sheets retract evenly thereon.

In accordance with the present invention, at least one surface 39 of at least one of the shade sheets facing on a dead air space 38 is reflective. In the preferred embodiment, at least one and preferably both surfaces of each of the internal sheets **22*b*–22*e*** are reflective and may be, for example, metal foil that develops very low emissivity in conjunction with its associated dead air space. Material sold under the trademark "Mylar" by the E. I. DuPont de Nemours & Co., when provided with an aluminized coating, is also suitable for use as the shade sheets to provide the reflective surface.

The reflective surfaces synergistically combine with an associated dead air space to effectively insulate against radiant heat transmission. To illustrate, if thermal conductance U is defined as the time rate of heat flow through a body (frequently per unit area) from one boundary surface to another for unit temperature difference under steady conditions, and thermal conductance R is defined as the reciprocal of thermal conductance, then R is a measure of the effectiveness of a body to prevent heat transmission. The thermal resistance $R_f$ of each surface, or the film resistance, of a free standing shade sheet, either reflective or non-reflective, is 0.68. Thus, the total thermal resistance, which is additive, of the entire shade sheet is $R_1 = 2R_f = 1.36$. The thermal resistance of two non-reflective shade sheets spaced apart to form a dead air space is $R_2$ and is equal to the outer film resistance of both sheets, $2R_f = 1.36$, plus the thermal resistance of the air space, $R_{as_1} = 0.96$. Therefore, $R_2 = 2R_f + R_{as_1} = 2.32$. This, of course, would also be the expected resistance of the shade configuration if the sheets had reflective surfaces. However, When the sheet surfaces facing the air space are made reflective, the thermal resistance of the air space is increased to $R_{as_2} = 2.95$ so that the total resistance $R_3 = 2R_f + R_{as_2} = 4.31$. Similar results are achieved as more air spaces are added. Accordingly, the apparatus of the present invention comprising a plurality of shade sheets enclosing a plurality of dead air spaces each associated with a reflective sheet surface, effectively insulates against convective, conductive, and radiant heat transmission.

In accordance with the present invention, it is particularly important that the spacer devices do not damage reflective shade sheet surfaces when a retracting mechanism is provided. A stationary non-rotatable spacer past which the shade sheets are drawn would abrade the highly reflective surface attached to or forming a part of the face, degrade its reflectivity, and thus limit its effectiveness in conjunction with the dead air spaces to insulate against head transmission. However, spacer devices of the type described above keep reflective surface abrasion to a minimum and thus preserve and extend its useful life.

The shade apparatus of the present invention also incorporates certain features which prevent development of convection currents between the apparatus and the window itself. As shown in FIG. 3, a flap 40 is attached to the outermost shade sheet **22*a* and is weighted by an elongated rod 42 to firmly contact the upper surface of sill 16 when the shade apparatus is in its drawn position. Accordingly, convection air currents are prevented from developing between the bottom of the shade apparatus and the sill. Similarly, a valance in the form of two depending loops 44 is mounted on the undersurface of the horizontal upper portion of frame 14. The loops 44 are sealed at locations 46 to also define dead air spaces 47. Further, each loop may have a reflective inner surface 49. Therefore, since the loops are positioned to contact the outermost shade sheet 22*f* as it is retracted onto roller 24**, they effectively prevent convection currents from developing between the frame and the top of the apparatus and also prevent conductive and radiant heat transmission.

As shown in FIGS. 1 and 7, a resilient seal arrangement, similar to the valance shown in FIG. 3, may be provided for the side of the shade apparatus. This arrangement 48, mounted on the side portions of frame 14, includes a pair of opposing loops 50, sealed at locations 51, and made, for example, from a plastic material having high elastic memory, which are formed to tightly contact the edges of the shade apparatus and prevent convection currents from developing thereby. These loops 50 also enclose dead air spaces 53 and may have a reflective inner surface 55.

As shown in FIG. 6, an alternative loop arrangement 57 may be used for either the top or side seal arrangements shown in FIGS. 3 and 7. This arrangement includes two loops 54 made of a resilient material, formed to press about the shade apparatus as it is retracted onto a roller 24 regardless of its diameter during various stages of shade sheet retraction.

Alternative forms of spacer devices shown in FIGS. 8 through 10, may be used to separate the shade sheets in the manner described above. Each alternative spacer embodiment is shown arranged to be retracted in a clockwise direction onto a roller rather than in a counterclockwise direction as shown in FIG. 3. FIG. 8 shows a spacer device which is integrally formed with its associated shade sheet to extend laterally thereacross. Specifically, each sheet 22 is formed at several vertically spaced locations with a first fold 58 that exceeds the elastic limit of the material from which the sheet is made and, therefore, is permanent, The fold may, for example, be bent in the counterclockwise direction. The sheet is then bent backwardly in the clockwise direction at 60 onto itself to form a loop 62. The face of the sheet 22 adjacent the first permanent fold 58 is bonded, for example, with adhesive or by heat sealing to the contacting face at a location 64. The sheet is then bent in a second permanent fold 66, again in the counterclockwise direction, at a location beyond the bond location 64. Thus, a portion of the sheet extends beyond to bond to form a moment arm 68. When a tension force, such as the weight of sheet itself, indicated by arrow F, is applied to opposite ends of a shade sheet 22, loop 62 tends to rotate outwardly away from the plane of the sheet about fold 58 as indicated by arrow R. In this manner, loop 62 acts as a lateral spacer between adjacent sheets in order to define a dead air space 38 therebetween. The respective dead air spaces operate as thermal insulators in the same manner described above. The loop 62 is also formed to roll tightly onto a retractor such as roller 24. A second alternative spacer is shown in FIG. 9 and comprises a loop 70 formed of an elongated strip, attached at its upper edge 72 to the shade sheet 22. The lower strip end is curved back and ultimately to be adhered to itself at 75. The loop material has low elastic memory. Therefore, when the shade apparatus is drawn the loop acts to equalize radial forces within it to accordingly assume a nearly circular cylindrical shape and space adjacent sheets apart. However, when retracted onto a roller 24, the loop 70 collapses to permit the shade sheets to be compacted in closely adjacent relation. A third alternative spacer device is shown in FIG. 10 and comprises a tear-shaped loop 80 formed of an elongated strip attached at its common free edges to shade sheet 22 at 82. This material from which loop 80 is formed also has low elastic memory and assumes a bulbous configuration when the apparatus is drawn in an attempt to equalize radial forces therein.

Other spacers which, for example, are mounted with the retracting mechanism but which roll with the shade sheet may also be employed.

It has been found that use of the apparatus of the present invention throughout the year can result in substantial conservation of energy. When used during the winter, this apparatus prevents substantial heat loss from the interior to the exterior of a building opening in which it is installed. The apparatus can be most effectively used during the winter months at night. Similarly, during the summer months, the apparatus of the present invention prevents substantial unwanted heat from entering the building from its exterior through the building opening. By way of example, it has been found that the preferred embodiment of the present invention having six shade sheets and enclosing five dead air spaces yields the following results:

TABLE 1

| | | Results without Shade Apparatus | Results with Shade Apparatus |
|---|---|---|---|
| Single Glass Pane Window | R | .96 | 16.67 |
| | U | 1.04 | .060 |
| Insulated Glass Pane Window | R | 1.54 | 17.25 |
| | U | .65 | .058 |

These results were obtained when both sides of each interior shade sheet are provided with a highly reflective coating facing on a dead air space and the emissivity E of each dead air space is equal to 0.03. It is apparent that this apparatus represents a 16-fold improvement over an uncovered window in preventing heat transmission when all other variables are maintained at constant values.

Note that the present invention may be practiced with more or less than six shade sheets. However, it has been found that the minimum number of sheets which provide acceptable results is three, thus enclosing two dead air spaces. Such a shade apparatus yields the following results:

TABLE 2

| | | Results without Shade Apparatus | Results with Shade Apparatus |
|---|---|---|---|
| Single Glass Pane Window | R | .96 | 7.82 |
| | U | 1.04 | .128 |
| Insulated Glass Pane Window | R | 1.54 | 8.40 |
| | U | .65 | .119 |

This apparatus then yields an eight-fold improvement over the single pane window in preventing convective, conductive, and radiant heat transmission again when all other variables are maintained at constant values.

Therefore, in its preferred embodiments, the apparatus of the present invention is extremely effective in preventing thermal heat losses to provide substantial conservation of energy.

Although specific embodiments of the present invention have been described above in detail, it is to be understood that this is only for purposes of illustration. Modifications may be made to be described structures by those skilled in the art in order to adapt this shade apparatus invention to particular applications where highly efficient insulation is desired in areas permitting installations having relatively small thickness dimensions.

What is claimed is:

1. An apparatus for insulating an area such as a window, door, or wall against conductive, convective, and radiant heat transmission comprising:

A. at least three essentially non-transparent, imperforate shade sheets;

B. retracting means for mounting said sheets for selective movement between a drawn position covering the area and a retracted position not covering the area; and C. spacer means mounted with at least one shade sheet of each pair of adjacent sheets for separating said adjacent sheets to provide a dead air space therebetween, said spacer means including at least one spacer device which comprises an elongated strip formed of sheet material having high elastic memory with an arcuate cross-sectional shape having an axis extending in the direction of the major axis of said strip, one of the edges of said strip being attached to one of said sheets.

2. The insulating apparatus as claimed in claim 1 wherein said retracting device is a roller and wherein said elongated strip is attached to said sheet to curve in the same direction as said roller when said sheet is retracted thereon.

3. An apparatus for insulating an area such as a window, door, or wall against conductive, convective, and radiant heat transmission comprising:

A. at least three essentially non-transparent, imperforate shade sheets;

B. retracting means for mounting said sheets for selective movement between a drawn position covering the area and a retracted position not covering the area; and C. spacer means mounted with at least one shade sheet of each pair of adjacent sheets for separating said adjacent sheets to provide a dead air space therebetween, said spacer means including at least one spacer device which comprises an elongated strip formed of sheet material attached at one edge to one of said shade sheets, the other edge not being attached to said sheet but curling back into the region of said attached edge to form a closed loop.

4. The insulating apparatus as claimed in claim 3 wherein said retracting device is a roller and wherein said elongated strip is attached to said sheet to curve in the same direction as said roller when said sheet is retracted thereon.

5. An apparatus for insulating an area such as a window, door, or wall against conductive, convective, and radiant heat transmission comprising:

A. at least three essentially non-transparent, imperforate shade sheets;

b. retracting means for mounting said sheets for selective movement between a drawn position covering the area and a retracted position not covering the area; and C. spacer means mounted with at least one shade sheet of each pair of adjacent sheets for separating said adjacent sheets to provide a dead air space therebetween, said spacer means including at least one spacer device which comprises an elongated strip formed of sheet material with a tear drop cross-sectional shape, one edge of said strip overlying the other and both edges being attached to one of said sheets.

6. An apparatus for insulating an area such as a window, door, or wall against conductive, convective, and radiant heat transmission comprising:

A. at least three essentially non-transparent, imperforate shade sheet;

B. retracting means for mounting said sheets for selective movement between a drawn position covering the area and a retracted position not covering the area; and C. spacer means mounted with at least one shade sheet of each pair of adjacent sheets for separating said adjacent sheets to provide a dead air space therebetween, said spacer means including at least one spacer device which comprises a loop formed of one of said sheets, to extend laterally thereacross, by folding said sheet back upon itself at a point intermediate its ends and attaching a portion of the folded, facing sheet surfaces together, whereby said loop rotates outwardly away from the plane of sheet when a tension force is applied intermediate the sheet ends and collapses against said sheet when the tension force is removed.

7. The insulating apparatus as claimed in claim 6 wherein said sheet is provided with two permanent identically directed folds and wherein said loop is formed by bending said sheet back upon itself and attaching the face of said sheet adjacent one of the folds to the face of said sheet at a location intermediate the folds wherein a portion of the sheet extends beyond the location of attachment to form a moment arm for rotating the loop outwardly away from the plane of the sheet when a tension force is applied intermediate the sheet ends.

8. An apparatus for insulating an area such as a window, door, or wall against conductive, convective, and radiant heat transmission comprising:

A. at least three essentially non-transparent, imperforate shade sheets, at least one of said sheets having at least one radiation reflective surface;

B. retracting means for mounting said sheets for selective movement between a drawn position covering the area and a retracted position not covering the area; and C. spacer means mounted with at least one shade sheet of each pair of adjacent sheets for separating said adjacent sheets to provide a dead air space therebetween; said spacer means comprising a plurality of spacer devices formed of a resilient flexible material having a normally expanded configuration which is assumed when said sheets are in the drawn position, said devices being formed to collapse when said sheets are in the retracted position, each spacer device being staggered along the sheet length with respect to the closest spacer device on a different sheet in order to permit said plurality of sheets to collapse relatively uniformly when in the retracted position.

* * * * *